US006932662B1

(12) United States Patent
Walczak

(10) Patent No.: US 6,932,662 B1
(45) Date of Patent: Aug. 23, 2005

(54) AIR INDUCTION SYSTEM WITHIN A COWL OF A MARINE PROPULSION SYSTEM

(75) Inventor: Thomas J. Walczak, Oconomowoc, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/793,408

(22) Filed: Mar. 4, 2004

(51) Int. Cl.[7] ..... B63H 20/32
(52) U.S. Cl. ..... 440/77; 440/88 A
(58) Field of Search ..... 440/77, 78, 88 A

(56) References Cited

U.S. PATENT DOCUMENTS

| | | | | |
|---|---|---|---|---|
| 5,046,976 | A * | 9/1991 | Kobayashi et al. | 440/77 |
| 5,181,870 | A | 1/1993 | Arai et al. | 440/77 |
| 5,277,633 | A | 1/1994 | Kato et al. | 440/77 |
| 5,328,395 | A | 7/1994 | Oishi | 440/77 |
| 5,391,099 | A | 2/1995 | Allain | 440/77 |
| 5,937,818 | A | 8/1999 | Kawai et al. | 123/198 E |
| 5,938,491 | A | 8/1999 | Kawai et al. | 440/77 |
| 6,132,273 | A | 10/2000 | Nakayama et al. | 440/77 |
| 6,296,536 | B1 | 10/2001 | Katayama et al. | 440/77 |
| 6,358,105 | B1 | 3/2002 | Isogawa et al. | 440/77 |
| 6,669,517 | B1 | 12/2003 | Alby et al. | 440/77 |
| 2001/0012740 | A1 * | 8/2001 | Kitsu et al. | 440/77 |

* cited by examiner

*Primary Examiner*—Stephen Avila
(74) *Attorney, Agent, or Firm*—William D. Lanyi

(57) ABSTRACT

A flow conditioning member is attached to a distal end, or lip, of an air conduit within a space formed by inner and outer walls of a cowl for an outboard motor. The flow conditioning member is shaped to decrease the likelihood that a thickened boundary layer will form within the conduit as air flows from an air passage formed through the cowl to an air intake system of an internal combustion engine. The flow conditioning member is shaped to block the passage of water from the air passage to the air conduit while improving the efficiency of air flow from the air passage, into a space between the inner and outer walls, and into the air conduit.

18 Claims, 4 Drawing Sheets

AIR INDUCTION SYSTEM WITHIN A COWL OF A MARINE PROPULSION SYSTEM

BACKGROUND OF THE INVENTION

1. Field of the Invention

The present invention is generally related to a cowl for a marine propulsion system and, more particularly, to an air intake path through a cowl of an outboard motor.

2. Description of the Prior Art

Many different types of cowls are known to those skilled in the art of marine propulsion systems and outboard motors. A cowl for an outboard motor serves several purposes. It provides a covering for an engine of the outboard motor and also allows air to pass from the ambient surroundings of the outboard motor to the air intake of the engine. The cowl protects the engine from the normal splashing of water that is inherent in the use of an outboard motor on a marine vessel. Openings formed through the cowl allow air to pass from the ambient surroundings to the air intake ducts of the outboard motor engine.

Those skilled in the art of marine propulsion systems and, more particularly, outboard motors are aware that cowls should allow air to pass to the air intake system of the engine in an outboard motor while minimizing the passage of water toward the air intake system of the engine.

U.S. Pat. No. 6,132,273, which issued to Nakayama et al. on Oct. 17, 2000, describes a cowling for an outboard motor. The cowling arrangement provides atmospheric air to the engine of an outboard motor for engine cooling and combustion while inhibiting water intake. The protective cowling incorporates one or more air inlets, an air chamber, and ducts of different sizes for permitting atmospheric air to enter the engine compartment. One of these ducts, which is disposed in part above electrical components of the engine, is substantially shorter in length than the other duct. This duct thus has a smaller flow area without unduly restricting air flow through the duct. An air chamber cover is affixed to the engine and shields the ducts to afford further water preclusion.

U.S. Pat. No. 6,358,105, which issued to Isogawa et al. on Mar. 19, 2002, describes a cowling arrangement for an outboard motor. The arrangement is intended for use with an outboard motor that is powered by an internal combustion engine. The improved arrangement includes a flywheel cover and cowling that incorporate upwardly and downwardly extending ribs which are positioned along an air path between the air vent of the outboard motor and the throttle body of the motor. These ribs act as labyrinth-type seals which prevent water entering the air vent from contacting the throttle body. Also disclosed is an improved cowling arrangement that prevents water pooled on the flywheel cover from draining onto the throttle body when the motor is tilted, such as when the watercraft banks into a turn.

U.S. Pat. No. 5,938,491, which issued to Kawai et al. on Aug. 17, 1999, describes a cowling air inlet for an outboard motor. The cowl defines an air inlet opening for an outboard motor that facilitates the ingestion of large amounts of air at low velocity. This aids in the assurance that water is not ingested into the engine. The configuration of the inlet opening is such that the water that is separated by the inlet system can easily flow away from the inlet opening and also the water that collects on the housing surfaces can be easily separated and will drain away from the actual inlet openings into the interior of the cowling.

U.S. Pat. No. 6,296,536, which issued to Katayama et al. on Oct. 2, 2001, describes a cowling assembly for an outboard motor. A cowl includes an improved construction that can supply relatively cool air containing little or no water to the induction device and that can also supply air to cool engine components without reducing the charging efficiency. The outboard motor has an engine that includes an air induction device and is enclosed by the cowling. The induction device has an air inlet opening.

U.S. Pat. No. 5,391,099, which issued to Allain on Feb. 21, 1995, describes an air intake protector for an outboard motor. A cowling for enclosing a marine propulsion unit with a recess having a port that communicates air to the engine is described. A plate having spaced-apart openings is received on the port. A diverter screen covers the openings. The diverter screen is adapted for communicating air from the openings through a diverter screen to the port and for restricting flow of water therethrough.

U.S. Pat. No. 5,328,395, which issued to Oishi on Jul. 12, 1994, describes a cowling structure for a marine propulsion engine. An outboard motor and particularly an improved protective cowling for an outboard motor is described which provides a very simple air inlet but one which is effective in preventing the passage of water to the interior of the protective cowling and for separating and draining water from the inducted air. The drained water is returned directly to the atmosphere. The air inlet system for the protective cowling is formed by only two members so as to facilitate a simple and low cost construction.

U.S. Pat. No. 5,937,818, which issued to Kawai et al. on Aug. 17, 1999, describes a ventilation system for an outboard motor. A ventilating system for an outboard motor having a water propulsion device and an internal combustion engine positioned in a cowling is described. The engine has an output shaft arranged to drive the water propulsion device. The ventilating system includes an air inlet in the cowling which permits air to flow into an engine compartment in which the engine is disposed and an exhaust port positioned in the cowling. The system also includes a mechanism for drawing air through the cowling into the compartment and expelling air out of the compartment through the exhaust port after the engine has stopped.

U.S. Pat. No. 5,046,976, which issued to Kobayashi et al. on Sep. 10, 1991, describes a cowling and air intake duct for an outboard motor. The air intake device is provided for the powerhead of an outboard motor which includes an air intake duct with a downwardly facing opening. The duct is mounted within an air inlet cavity formed within an upper rear portion of the cowling. A cover is secured to the cowling to form the top surface of the air inlet and to cover the intake duct. The air inlet inducts air from the atmosphere to a rearwardly facing opening wherein the air is drawn up into the intake duct for supply to the induction system of the outboard motor's internal combustion engine. The downwardly facing intake duct insures that water will not enter into the interior of the cowling or into the engine induction system.

U.S. Pat. No. 5,277,633, which issued to Kato et al. on Jan. 11, 1994, describes a cowling for a marine propulsion engine. The cowling structure for a marine propulsion engine effectively prevents water from entering into the air intake opening while at the same time maintaining optimum engine performance. The cowling structure has an engine cowl which encloses the engine and which defines an air intake opening. An air duct molding is associated with the engine cowl such that it extends over the air intake opening and, in conjunction with the engine cowl, defines an air inlet facing toward a rear portion of the cowling structure. A wall extends between the engine cowl and the air duct molding and is located between the air intake opening and the air inlet. Sidewalls, which are spaced apart a distance less than the width of the wall, direct any water entering the air inlet towards the wall to effectively prevent the water from entering the air intake opening.

U.S. Pat. No. 5,181,870, which issued to Arai et al. on Jan. 26, 1993, describes a cowling and air inlet device for an outboard motor. Several embodiments of a cowling and air intake device for a powerhead of an outboard motor are disclosed. These include an air inlet formed in an upper rear surface of the cowling and an air intake duct formed within the air inlet for supplying air to the engine induction system. Various arrangements of partitions are provided within the air inlet for permitting adequate air flow to the engine induction system but preventing water from entering the interior of the cowling and the engine induction system.

U.S. Pat. No. 6,669,517, which issued to Alby et al. on Dec. 30, 2003, discloses a multiple part cowl structure for an outboard motor. A cowl structure comprises first and second cowl members that are independent components. A first cowl member is attachable, by a latch mechanism, to a support structure of the outboard motor. The second cowl member is attachable by a latch mechanism, to both the first cowl member and the support structure. The first cowl member extends across a rear portion of the outboard motor and at least partially along both port and starboard sides of the outboard motor. The second cowl member extends across a front portion of the outboard motor and at least partially along the port and starboard sides of the outboard motor. In a preferred embodiment, the second cowl member also extends partially over a top portion of the outboard motor and over a rear portion of the outboard motor.

The patents described above are hereby expressly incorporated by reference in the description of the present invention.

As can be seen in a review of the above referenced United States patents, many different techniques are known, and have been used, to allow air to freely flow through the cowl structure toward the air induction system of an engine while inhibiting the flow of water in that same direction. Many different structures have been incorporated in cowl devices which inhibit or prevent water from flowing into the engine's air induction system while allowing air to flow from the ambient surroundings of the outboard motor, external to the cowl, to the air induction system of the engine.

It would be significantly beneficial if an air flow system could be provided which directs a flow of air through the structure of a cowl while preventing the flow of water into the air induction system of the engine in such a way that the devices used to inhibit the water flow do not adversely reduce the efficiency of the air flow.

SUMMARY OF THE INVENTION

An air induction system for a marine propulsion system, made in accordance with a preferred embodiment of the present invention, comprises an inner wall and an outer wall, with the inner and outer walls defining a space between them. An air conduit extends through the inner wall and into the space in a direction toward the outer wall. The air conduit has a distal end extending into the space. An air passage is formed through the outer wall. The air passage is in fluid communication with the space between the inner and outer walls and also with the air conduit. A flow directing member is disposed at the distal end of the air conduit.

In a particularly preferred embodiment of the present invention, the distal end of the air conduit comprises a lip portion and the flow directing member is attached to the lip portion. The flow directing member has an outer surface area with a first radius of curvature and a distal end has a second radius of curvature. The first radius of curvature is greater than the second radius of curvature.

The flow directing member is shaped to inhibit the liquid from passing through the space directly from the air passage to the air conduit. The outer wall can be removably attachable to the inner wall. The flow directing member is shaped to reduce the vena contracta effect within the air conduit. As such, the flow directing member is shaped to reduce the thickness of a boundary layer within the air conduit. In a preferred embodiment, the air conduit is made of plastic and the flow directing member is made of rubber.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
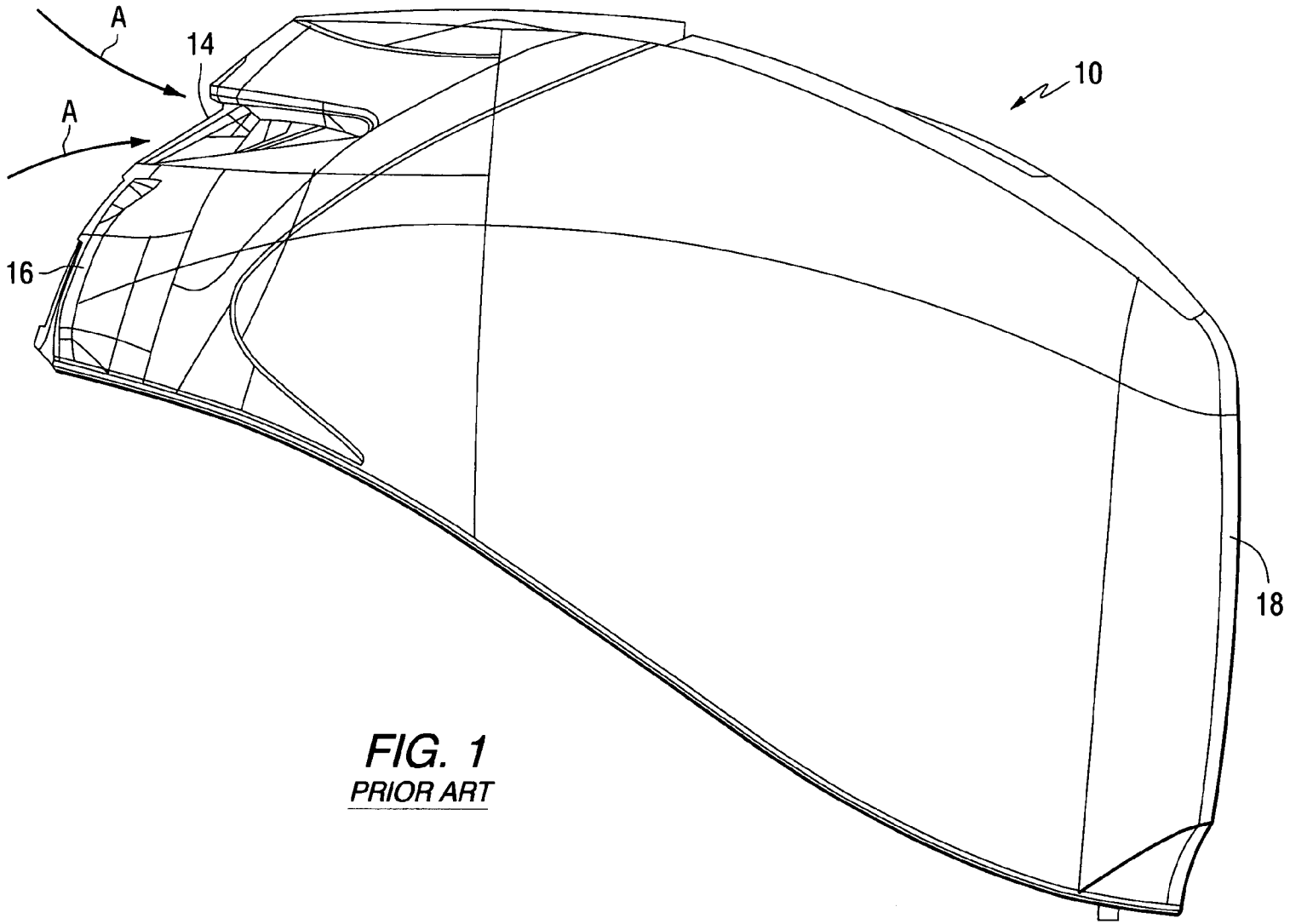
FIG. 1 PRIOR ART
FIG. 1 shows an outer cowl of an outboard motor.

Throughout the description of the preferred embodiment of the present invention, like components will be identified by like reference numerals.

FIG. 1 is a side view of a cowl 10 that is used with an outboard motor. The cowl shown in FIG. 1 is a portion, or selection, of a multiple-piece cowl which is disclosed in U.S. Pat. No. 6,669,517.

With continued reference to FIG. 1, air can flow into an air passage 14, as represented by arrows A from a region in the ambient surroundings of the rear portion 16 of the cowl 10. Reference numeral 18 identifies a front portion of the cowl 10 when it is attached to an outboard motor that is mounted on a marine vessel. Its configuration can also be seen in more detail in the figures of U.S. Pat. No. 6,669,517.

Figure 2:
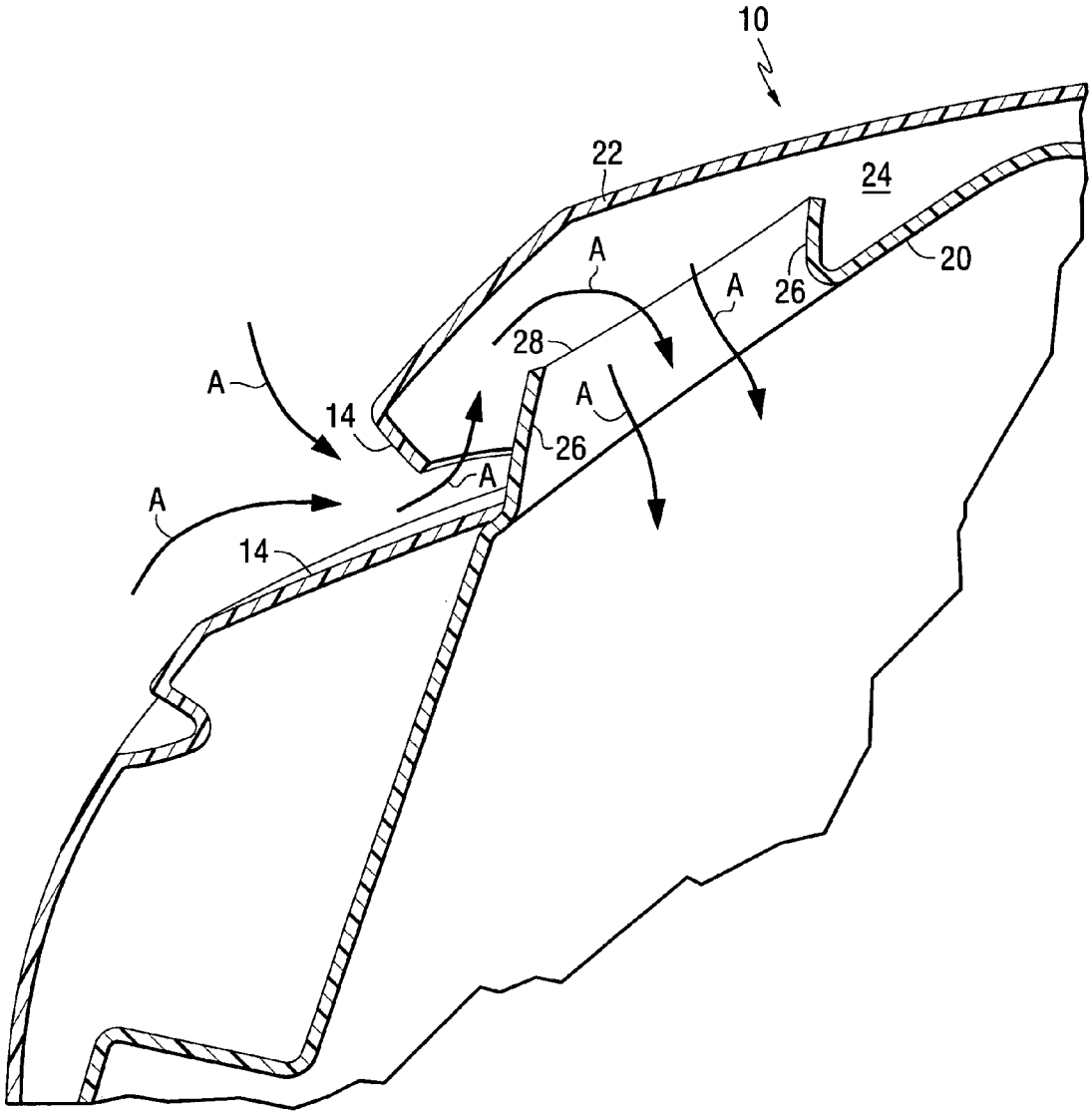
FIG. 2 is a partially sectioned view of the rear portion of the cowl illustrated in FIG. 1.

FIG. 2 is a section view of the rear portion 16 of the cowl 10 which is described above in conjunction with FIG. 1. The cowl 10 comprises an inner wall 20 and an outer wall 22. The inner and outer walls, 20 and 22, define a space 24 therebetween. An air conduit 26 extends through the inner wall 20 in a direction toward the outer wall 22. The air conduit 26 has a distal end 28 extending into the space 24. When in use, air flows in the directions represented by arrows A from the region proximate the external surfaces of the cowl 10, through the air passage 14, into the space 24, and downward through the air conduit 26. From there, the air flows toward and into an air induction system of the engine which is not illustrated in FIG. 2. However, those skilled in the art of outboard motor design are well aware that air passing into the internal cavity of a cowl will naturally and inherently flow toward the intake manifold and throttle body of an engine disposed under the cowl 10.

Two problems can occur in an air induction system such as that shown in FIG. 2. First, water can flow with the air in a direction generally similar to arrows A in FIG. 2 and pass into and through the air conduit 26. When this occurs, the water will usually strike the engine disposed under the cowl and, in certain circumstances, be ingested into the air intake system of the engine. As described in conjunction with the patents identified above, many different techniques have been used to inhibit water flow through an opening in the cowl, such as the air passage 14, and into the space under the cowl.

A related problem involves the air flow as it passed from the air passage 14 to the internal portion of the air conduit 26. The distal edge 28 of the air conduit can create a condition that is not conducive to efficient air flow toward the air induction system of the internal combustion engine.

Figure 3:
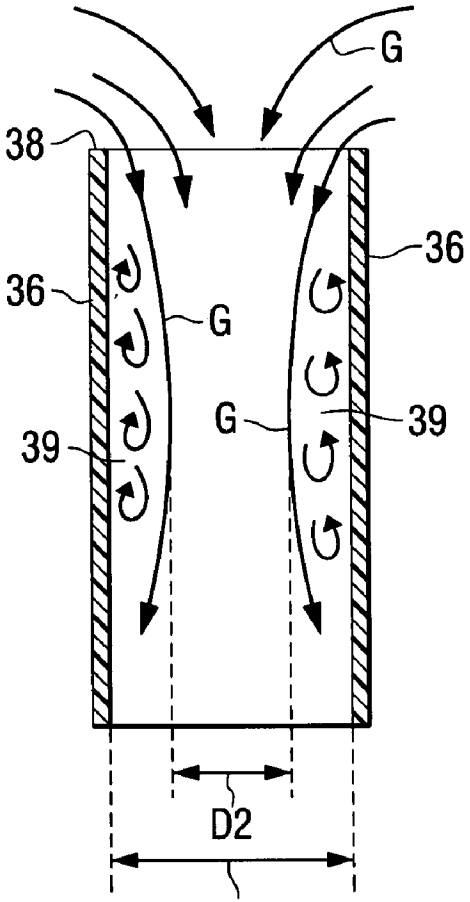

FIG. 3 schematically illustrates the problem that can occur when air flows into the opening of a conduit. In FIG. 3, the air conduit is identified by reference numeral 36 and is used to analogously represent the flow of air A described above in conjunction with FIG. 2 as it passes toward and into the air conduit 26. The arrows in FIG. 3 represent the flow of a gas G as it flows past the distal edge 38 of the conduit 36 and downward through the internal cavity of the conduit. As those who are skilled in the art of fluid flow know, passage of a fluid into the mouth of a conduit 36 can be subjected to a physical effect referred to as vena contracta. This effect causes the flow of the gas G to move away from the walls of the conduit 36, creating a relatively thick boundary layer in the region identified by reference numeral 39 in FIG. 3. As a result, the effective diameter of the conduit 36 is reduced from its actual diameter D1 to a smaller effective diameter D2 because of the thickened boundary layer 36. For purposes of this explanation, the gas is shown as a plurality of eddy currents within the enlarged boundary layer region 39. As a result of the vena contracta effect described above in conjunction with FIG. 3, the efficient flow of gas through the conduit 36 is reduced.

Figure 4:
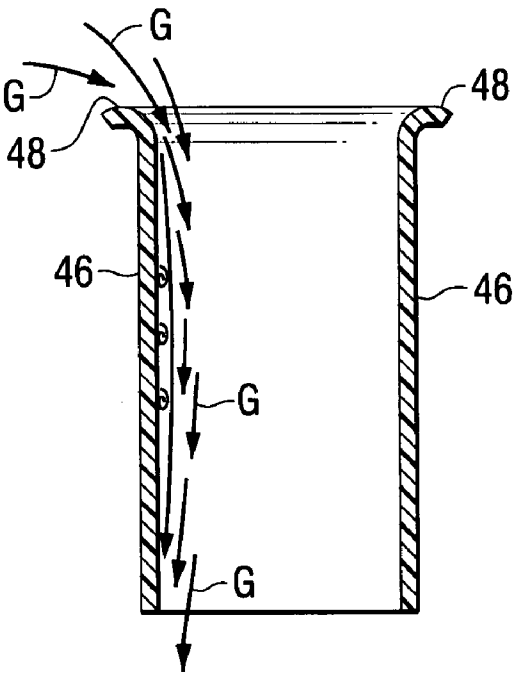

FIG. 4 shows a conduit 46 with an upper distal edge 48 that is slightly rounded to form a bell-like flange at the mouth of the conduit 46. This formation has the effect of providing a larger radius of curvature near the inlet opening of the conduit 46 than in the conduit 36 described above in conjunction with FIG. 3. This smoother surface, compared to the relatively sharp edge 38 of conduit 36 in FIG. 3, allows the gas G to flow more closely to the surface of the conduit 46. This beneficial effect is sometimes referred to as the coanda effect. As a result, the boundary layer which is relatively thick in region shown in FIG. 3 and identified by reference numeral 39, is much thinner. Therefore, the conduit 46 does not have the reduced effective diameter D2 and thickened boundary layer 39 as described above in conjunction with FIG. 3. The flow of gas through conduit 46 in FIG. 4 is therefore more efficient because of this reduced boundary layer and enlarged effective diameter of the conduit.

Figure 5:
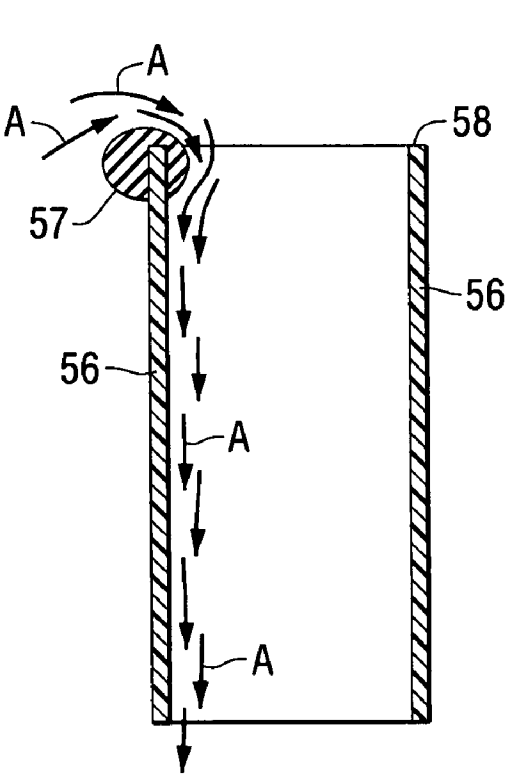
FIGS. 3–5 are used to illustrate the benefits of certain shapes formed at the inlet end of a conduit.

FIG. 5 shows a conduit 56 that is generally similar to the conduit 36 illustrated in FIG. 3. However, a flow conditioning member 57 is disposed at the distal edge 58 of the conduit 56. The flow conditioning member 57 can be made of hard rubber and the conduit 56 can be made of plastic. The flow of air A in FIG. 5 is more efficient than the flow of air in FIG. 3. Because of the surface shape of the flow conditioning member 57, which acts in a manner which results in a generally similar effect as the bell-shaped of the distal end 48 described above in conjunction with FIG. 4, takes advantage of the coanda effect and allows the air flow A to pass more closely to the internal walls of the conduit 56 and not experience the enlarged boundary layer 39 as described above in conjunction with FIG. 3.

With continued reference to FIGS. 3–5, the present invention could benefit from the use of a bell-shaped distal end 48 similar to that illustrated in FIG. 4. However, if the conduit 46 is part of a larger structure, the bell-shape at the distal end 48 can make manufacturing more difficult, particularly if the conduit is made of plastic and formed in a die.

Figure 6:
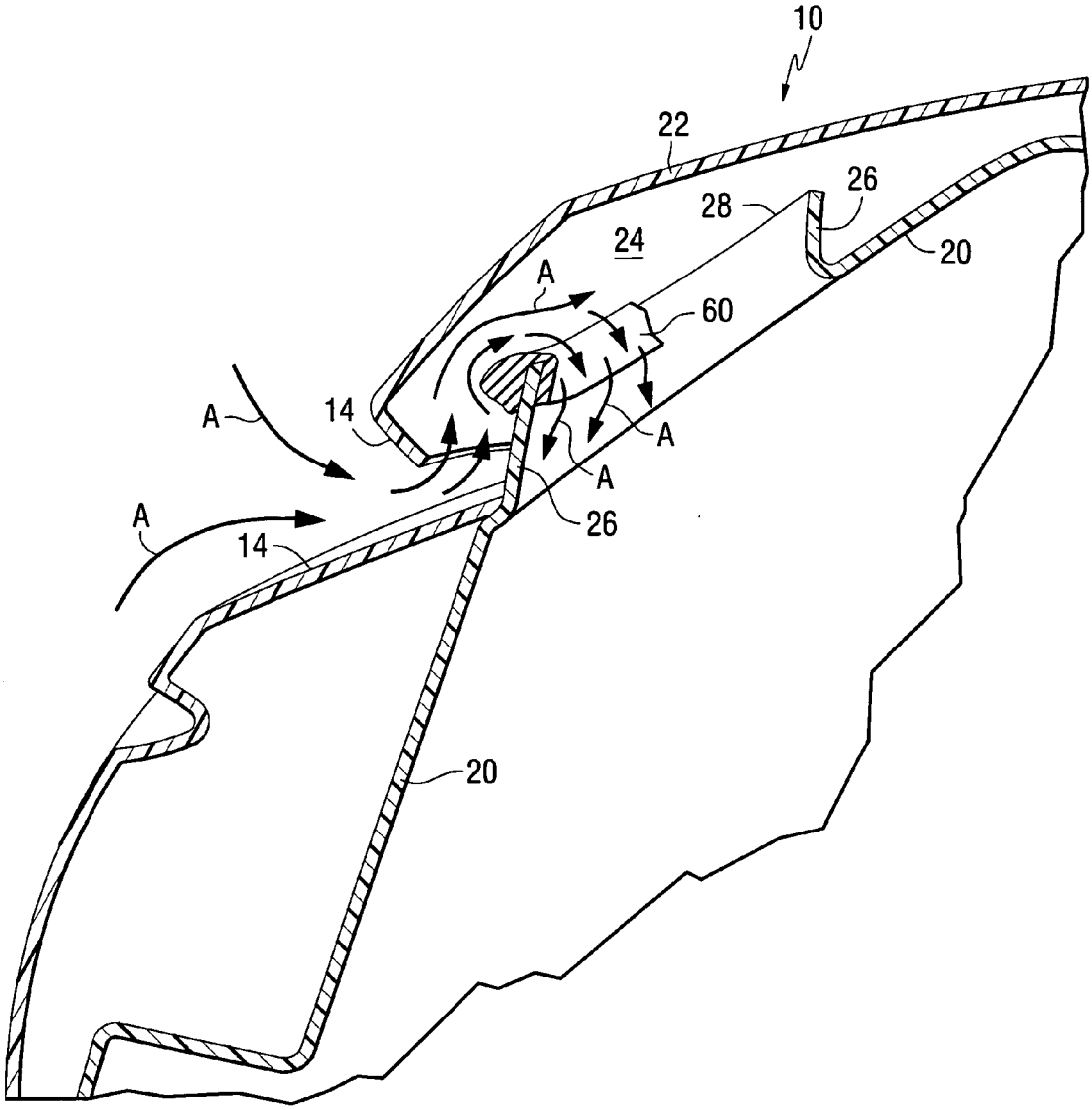
FIG. 6 shows a section view of the cowl of an outboard motor with a flow conditioning member attached to a distal end of an internal conduit through which air flows from a position outside of the cowl to the air induction system of an engine disposed under the cowl.

FIG. 6 is generally similar to FIG. 2, but with a flow conditioning member 60 disposed at the distal end 28 of the air conduit 26. Arrows A represent the flow of air through the air passage 14, into the space 24, around the flow conditioning member 60, and downwardly through the opening of the air conduit 26. The flow conditioning member performs two valuable functions when used in conjunction with an air conduit 26 of a cowl. First, it protrudes into the space through which the air A passes as it enters the air passage 14. As such, it decreases the likelihood that water will flow in a direct line through the air passage 14 and into the space 24 to a location where it can easily pass downwardly into the air conduit 26. A significant portion, if not all, of the water entering the air passage 14 will strike the protrusion of the flow conditioning member 60 and not enter the space 24. A second important function performed by the flow conditioning member 60 is the provision of a greater radius of curvature along its surface that induces the coanda effect described above in conjunction with FIGS. 4 and 5. As a result, the air flow A passes along the surface of the flow conditioning member 60 and downward through the air conduit 26 close to its internal walls. This inhibits the formation of thickened boundary layers and, as a result, prevents the narrowing of the effective diameter of the air conduit 26.

With continued reference to FIG. 6, it can be seen that the flow conditioning member 60 is shown extending along only a portion of the periphery of the distal end 28 of the air conduit 26. It should be understood that the percentage of the total periphery on which the flow conditioning member 60 extends is not limiting to the present invention. However, in a particularly preferred embodiment, the total length of the flow conditioning member 60 does not extend around the entire periphery of the air conduit 26. Instead, it is placed along the most likely path where the water and air flow will pass. Because of the structure of the cowl and the shape of the space 24 which is defined by the inner and outer walls, 20 and 22, the passage of air over the distal end 28 that is nearest to the air passage 14 is most likely. As a result, the flow conditioning member 60, in a preferred embodiment of the present invention, is only used over that particular portion of the distal end 28 of the air conduit 26. Alternatively, the flow conditioning member 60 can be selected to have a length which coincides with the total periphery of the conduit 26 so that its entire distal end 28 would be covered by a portion of the flow conditioning member 60.

With reference to FIGS. 1, 2, and 6, an air induction system for a marine propulsion system, made in accordance with a preferred embodiment of the present invention, comprises an inner wall 20 and an outer wall 22. The inner and outer walls define a space 24 between them. An air conduit 26 extends through the inner wall 20 into the space 24 in a direction toward the outer wall 22. The air conduit 26 has a distal end 28 extending into the space 24. An air passage 14 is formed through the outer wall 22. The air passage 14 is in fluid communication with a space 24 between the inner and outer walls, 20 and 22, and with the air conduit 26. A flow conditioning member 26 is disposed at the distal end 28 of the air conduit 26. The flow conditioning member is shaped to inhibit a liquid from passing through the space 24 from the air passage 14 to the air conduit 26. The outer wall 22 is moveable attachable to the inner wall 20. The flow conditioning member 60 is shaped to reduce the thickness of a boundary layer within the air conduit 26. The flow conditioning member 60 has an outer surface area having a first radius of curvature and the distal end 28 has a second radius of curvature. The first radius of curvature is greater than the second radius of curvature. The flow conditioning member 60 is attached to the distal end 28 of the air conduit 26. In a preferred embodiment, the air conduit 26 is made of plastic and the flow conditioning member 60 is made of rubber.

Although the present invention has been described with particular detail and illustrated to show a preferred embodiment, other embodiments are also within its scope.

I claim:

1. An air induction system for a marine propulsion system, comprising:

an inner wall;

an outer wall, said inner and outer walls defining a space therebetween;

an air conduit extending through said inner wall into said space in a direction toward said outer wall, said air conduit having a distal end extending into said space;

an air passage formed through said outer wall, said air passage being in fluid communication with said space between said inner and outer walls and with said air conduit; and a flow directing member disposed at said distal end of said air conduit, said flow directing member having an outer surface area having a first radius of curvature, said distal end having a second radius of curvature, said first radius of curvature being greater than said second radius of curvature.

2. The air induction system of claim 1, wherein:

said distal end comprises a lip portion.

3. The air induction system of claim 2, wherein:

said flow directing member is attached to said lip portion.

4. The air induction system of claim 1, wherein:

said flow directing member is shaped to inhibit a liquid from passing through said space from said air passage to said air conduit.

5. The air induction system of claim 1, wherein:

said outer wall is removably attachable to said inner wall.

6. The air induction system of claim 1, wherein:

said flow directing member is shaped to reduce the vena contracta effect within said air conduit.

7. The air induction system of claim 1, wherein:

said flow directing member is shaped to reduce the thickness of a boundary layer within said air conduit.

8. The air induction system of claim 1, wherein:

said air conduit is made of plastic.

9. The air induction system of claim 8, wherein:

said flow directing member is made of rubber.

10. An air induction system for a marine propulsion system, comprising:

an inner wall;

an outer wall, said inner and outer walls defining a space therebetween;

an air conduit extending through said inner wall into said space in a direction toward said outer wall, said air conduit having a distal end extending into said space;

an air passage formed through said outer wall, said air passage being in fluid communication with said space between said inner and outer walls and with said air conduit; and a flow conditioning member disposed at said distal end of said air conduit, said flow conditioning member having an outer surface area having a first radius of curvature, said distal end having a second radius of curvature, said first radius of curvature being greater than said second radius of curvature.

11. The air induction system of claim 10, wherein:

said flow conditioning member is shaped to inhibit a liquid from passing through said space from said air passage to said air conduit.

12. The air induction system of claim 11, wherein:

said flow conditioning member is attached to said distal end.

13. The air induction system of claim 12, wherein:

said outer wall is removably attachable to said inner wall.

14. The air induction system of claim 13, wherein:

said flow conditioning member is shaped to reduce the thickness of a boundary layer within said air conduit.

15. An air induction system for a marine propulsion system, comprising:

an inner wall;

an outer wall, said inner and outer walls defining a space therebetween;

an air conduit extending through said inner wall into said space in a direction toward said outer wall, said air conduit having a distal end extending into said space;

an air passage formed through said outer wall, said air passage being in fluid communication with said space between said inner and outer walls and with said air conduit; and a flow conditioning member disposed at said distal end of said air conduit, said flow conditioning member being shaped to inhibit a liquid from passing through said space from said air passage to said air conduit, said outer wall being removably attachable to said inner wall, said flow conditioning member being shaped to reduce the thickness of a boundary layer within said air conduit.

16. The air induction system of claim 15, wherein:

said flow conditioning member has an outer surface area having a first radius of curvature; and said distal end has a second radius of curvature, said first radius of curvature being greater than said second radius of curvature.

17. The air induction system of claim 16, wherein:

said flow conditioning member is attached to said distal end.

18. The air induction system of claim 17, wherein:

said air conduit is made of plastic; and said flow conditioning member is made of rubber.

* * * * *